US008643560B2

(12) United States Patent
Mahon et al.

(10) Patent No.: US 8,643,560 B2
(45) Date of Patent: Feb. 4, 2014

(54) ROTATABLE POLARIZER/FILTER DEVICE AND FEED NETWORK USING THE SAME

(75) Inventors: John P. Mahon, Thousand Oaks, CA (US); Cynthia P. Espino, Carlsbad, CA (US)

(73) Assignee: Optim Microwave, Inc., Camarillo, CA (US)

( * ) Notice: Subject to any disclaimer, the term of this patent is extended or adjusted under 35 U.S.C. 154(b) by 364 days.

(21) Appl. No.: 13/045,808

(22) Filed: Mar. 11, 2011

(65) Prior Publication Data

US 2012/0229232 A1 Sep. 13, 2012

(51) Int. Cl.

| | |
|---|---|
| ***H01Q 13/06*** | (2006.01) |
| ***H01P 1/165*** | (2006.01) |
| ***H01P 9/00*** | (2006.01) |

(52) U.S. Cl.
USPC ..... 343/772; 333/21 A; 333/157

(58) Field of Classification Search
USPC ..... 333/21 A, 21 R, 122, 126, 135, 137, 208, 333/157; 343/772, 756
See application file for complete search history.

(56) References Cited

U.S. PATENT DOCUMENTS

| | | | | |
|---|---|---|---|---|
| 2,716,221 | A | 9/1955 | Allen | |
| 2,783,439 | A | 2/1957 | Whitehorn | |
| 3,164,789 | A | 1/1965 | Grosbios et al. | |
| 4,613,836 | A | 9/1986 | Evans | |
| 4,672,334 | A * | 6/1987 | Saad | 333/21 A |
| 4,806,945 | A | 2/1989 | Cormier et al. | |
| 6,417,742 | B1 | 7/2002 | Enokuma | |
| 7,772,940 | B2 | 8/2010 | Mahon et al. | |
| 2009/0284327 | A1 * | 11/2009 | Mahon et al. | 333/157 |

* cited by examiner

*Primary Examiner* — Benny Lee
*Assistant Examiner* — Rakesh Patel
(74) *Attorney, Agent, or Firm* — SoCal IP Law Group LLP; John E. Gunther; Mark A. Goldstein

(57) ABSTRACT

A feed network may include a cylindrical common waveguide terminating in a common port and an orthomode transducer having a first port for coupling a first linearly polarized mode to the cylindrical common waveguide and a second port for coupling a second linearly polarized mode to the cylindrical common waveguide, the second linearly polarized mode orthogonal to the first linearly polarized mode. A filter-polarizer element may be disposed within the cylindrical common waveguide. The filter-polarizer element may be rotatable about an axis of the cylindrical common waveguide. The filter-polarizer element may be configured to cause a predetermined relative phase shift between a first signal and a second signal propagating in the cylindrical common waveguide. The filter-polarizer element may be further configured to suppress propagation of at least one undesired mode in the cylindrical common waveguide.

15 Claims, 9 Drawing Sheets

ROTATABLE POLARIZER/FILTER DEVICE AND FEED NETWORK USING THE SAME

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to rotatable polarizer devices for use in cylindrical waveguides.

2. Description of the Related Art

Satellite broadcasting and communications systems, such as Ku band very small aperture terminal (VSAT) communications systems, may use orthogonally polarized signals within the same frequency band for the uplink to and downlink from satellites.

A common form of antenna for transmitting and receiving signals from satellites consists of a parabolic dish reflector and a feed network where orthogonally polarized modes travel in a circular waveguide. Note that the term "circular" refers to the cross-sectional shape of the waveguide. An ortho-mode transducer may be used to launch or extract the orthogonal linearly polarized modes into or from the circular waveguides.

An ortho-mode transducer (OMT) is a three-port waveguide device having a common waveguide coupled to two branching waveguides. Within this description, the term "port" refers generally to an interface between devices or between a device and free space. A port may include an interfacial surface, an aperture in the interfacial surface to allow microwave radiation to enter or exit a device, and provisions to mount or attach an adjacent device.

The common waveguide of an OMT typically supports two orthogonal linearly polarized modes. Within this document, the terms "support" and "supporting" mean that a waveguide will allow propagation of a mode with little or no loss. In a feed system for a satellite antenna, the common waveguide may be a circular waveguide. The two orthogonal linearly polarized modes may be $TE_{11}$ modes which have an electric field component orthogonal to the axis of the common waveguide. When the circular waveguide is partially filled with a dielectric material, the two orthogonal linearly polarized modes may be hybrid $HE_{11}$ modes which have at least some electric field component along the propagation axis. Two precisely orthogonal $TE_{11}$ or $HE_{11}$ modes do not interact or cross-couple, and can therefore be used to communicate different information.

The common waveguide terminates at a common port aperture. The common port aperture is defined by the intersection of the common waveguide and an exterior surface of the OMT.

Each of the two branching waveguides of an OMT typically supports only a single linearly polarized $TE_{10}$ mode. The mode supported by the first branching waveguide is orthogonal to the mode supported by the second branching waveguide. Within this document, the term "orthogonal" will be used to describe the polarization direction of modes, and "normal" will be used to describe geometrically perpendicular structures.

A satellite communications system may use a signal having a first polarization state for the uplink to the satellite and a signal having a second polarization state, orthogonal to the first polarization state, for the downlink from the satellite. Note that two circularly polarized signals are orthogonal if the e-field vectors rotate in the opposite directions. The polarization directions for the uplink and downlink signals may be determined by the antenna and feed network on the satellite. To ensure maximum coupling of the signals to and from the satellite, each terrestrial antenna may include provisions to adjust the polarization directions of the uplink and downlink signals to exactly match the polarization directions defined at the satellite. In present antennas, the polarization directions of the uplink and downlink signals may be adjusted by rotating the entire antenna or by rotating all or portions of the feed network including the OMT. In either case, the item being rotated is heavy and the cables connecting to the feed network must be repositioned.

U.S. Pat. No. 7,772,940 describes a feed network including an integrated OMT and polarization controller. A rotatable phase shifting element disposed in a common waveguide coupled to the common port of the OMT. The rotatable phase shifting element is configured to introduce a phase shift between two signals having orthogonal polarization states. The polarization of the uplink and downlink signals in the common waveguide may be precisely adjusted by rotating the rotatable phase shifting element.

When a satellite communications system uses orthogonal linearly polarized signals for the uplink to the satellite and the downlink from the satellite, the rotating phase shifting element may introduce a 180-degree phase shift to allow adjustment of the polarization direction of two orthogonal linearly polarized signals in the common waveguide of the feed network. When a satellite communications system uses orthogonal circularly polarized signals for the uplink to the satellite and the downlink from the satellite, the rotating phase shifting element may introduce a 90-degree phase shift to allow adjustment of the ellipticity of two orthogonal polarized signals in the common waveguide of the feed network.

FIG. 9 is a perspective, partially cross-sectional, view of a prior art rotatable phase shifting element 900 developed by the inventors of the present patent. The phase shifting element 900 is shown within a cylindrical waveguide 910 which terminates in flanges 912 and 914. The cylindrical waveguide 910 is shown in partial cross-section to allow the phase shifting element 900 to be seen. The phase shifting element 900 includes a dielectric card 920 which extends into a dielectric cylinder 930. The opposing ends of the dielectric card 920 and the dielectric cylinder 930 are coupled to stems 940, 942 which may be rotatable within bearings (not shown).

The dielectric card has a rectangular cross-section that spans or nearly spans the inside diameter of the cylindrical waveguide in a first direction and is much smaller in a second direction orthogonal to the first direction. The effect of the dielectric card is to slow propagation of a first electromagnetic wave polarized in the first direction with respect to a second electromagnetic wave polarized in the second direction. By selecting the proper length of the dielectric card, the phase of the first electromagnetic may be shifted with respect to the phase of the second electromagnetic wave by a desired amount such as 90 degrees or 180 degrees.

A structure such as the phase shifting element 900 may cause undesired resonances within the operating bandwidth of a feed network. In the phase shifting element 900, undesired resonances were suppressed by a series of irregularly spaced slots 925 in the dielectric card 920. The slots 925 were located by trial and error.

DESCRIPTION OF THE DRAWINGS

Elements in the drawings are assigned reference numbers which remain constant between the figures. An element not described in conjunction with a figure may be presumed to be the same as an element having the same reference number described in conjunction with a previous figure.

DETAILED DESCRIPTION

Description of Apparatus

Figure 1:
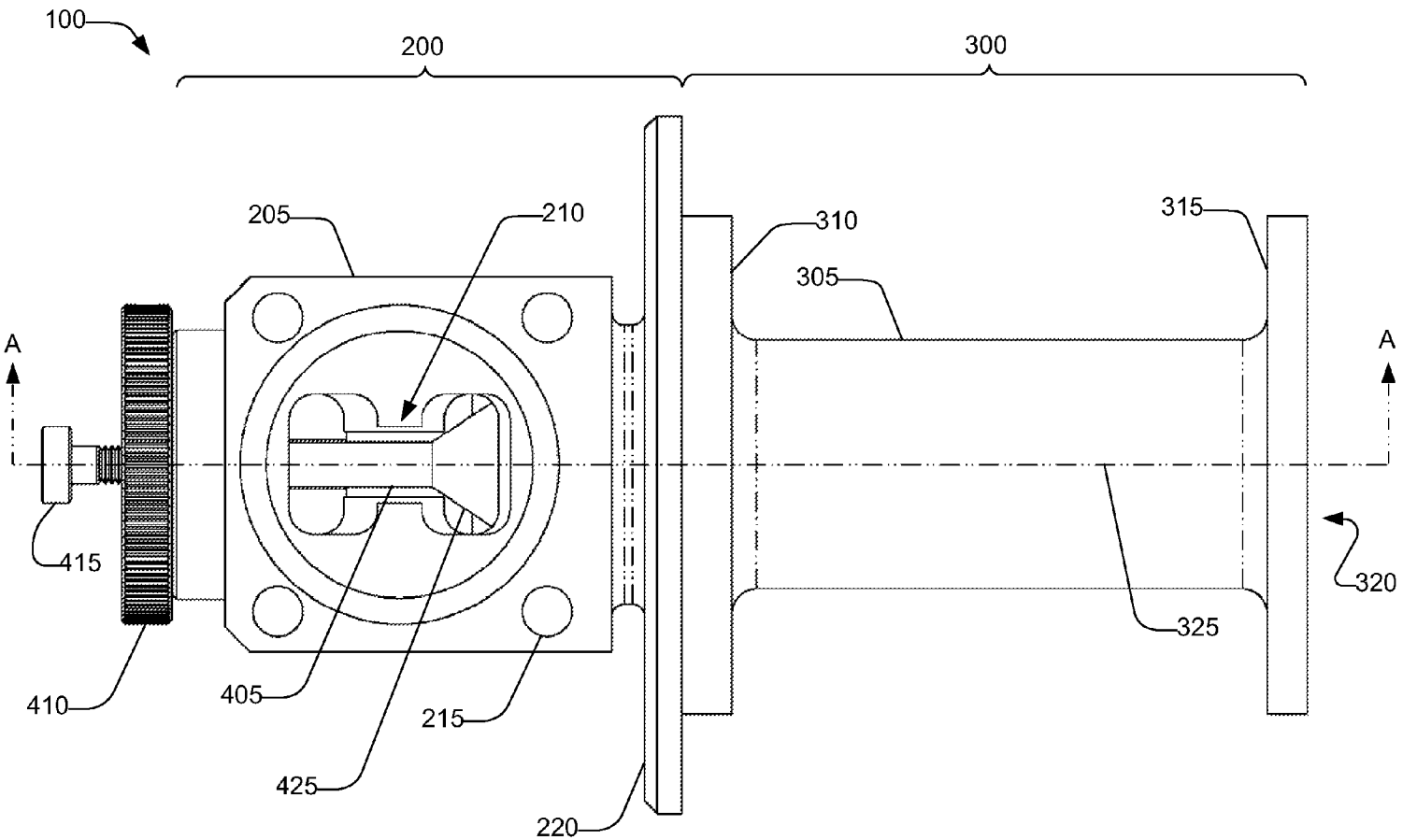
FIG. 1 is a top view of an exemplary feed network.

Referring now to FIG. 1, an exemplary feed network 100, which may be a feed network for a satellite communications system, may include an ortho-mode transducer (OMT) 200 coupled to a cylindrical waveguide 300. The cylindrical waveguide 300 may include a cylindrical tube 305. A first flange 310 and a second flange 315 may be disposed at the ends of the cylindrical tube 305 to facilitate attaching the cylindrical waveguide to adjacent waveguide components. An opening at the end of the cylindrical tube 305 proximate to the second flange 315 may define a common port 320.

The OMT 200 may be formed as a series of machined cavities within an OMT body 205. The machined cavities may be coupled to two branch ports. The OMT 200 may include a first branch port 210 for coupling a first $HE_{11}$ mode into or from the cylindrical waveguide 300. Threaded mounting holes 215 may be provided adjacent to the first branch port 210 to facilitate coupling a waveguide or other component (not shown) to the first port. In applications where orthogonally polarized signals are used to communicate different information, the OMT 200 may include a second branch port, not visible in FIG. 1, for coupling a second $HE_{11}$ mode into or from the cylindrical waveguide 300. A polarization direction of the first $HE_{11}$ mode may be orthogonal to a polarization direction of the second $HE_{11}$ mode. Where both the first and second branch ports are present, the first and second branch ports may be referred to as the "vertical" port and the "horizontal" port, respectively. However, the terms "vertical" and "horizontal" do not imply any absolute orientation of the OMT 200 or the feed network 100.

The OMT 200 may include a common port flange 220. The common port flange 220 may be coupled to the first flange 310 of the cylindrical waveguide 300 using bolts, rivets, or some other fasteners (not shown). The flanges 220, 310, and 315 are representative of typical feed network structures. However, the OMT 200 and the cylindrical waveguide 300 may be fabricated as a single piece, or may be coupled by soldering, bonding, welding, or other method not requiring the use of the flanges 220, 310, and 315 and/or fasteners.

A rotatable filter-polarizer element may be disposed within the OMT 200 and the cylindrical waveguide 300. The term "filter-polarizer" is used to describe this element because it functions both as a phase shifting element to change the polarization state of signals propagating in the cylindrical waveguide 300, and as a filter to inhibit propagation of one or more undesired modes. The only portions of the rotatable filter-polarizer element visible in FIG. 1 are a cylindrical stem 405 and a conical portion 425 that can be seen through the first branch port 210. The rotatable filter-polarizer element may extend through the OMT 200 and the cylindrical waveguide 300. The cylindrical stem 405 of the rotatable filter-polarizer may be coupled to an adjustment knob 410 disposed outside of the OMT 100. The adjustment knob 410 and the rotatable filter-polarizer element may be adapted to be rotatable about an axis 325 of the cylindrical waveguide 300. A locking mechanism, such as a lock screw 415, may be provided to prevent inadvertent movement of the adjustment knob.

Figure 2:
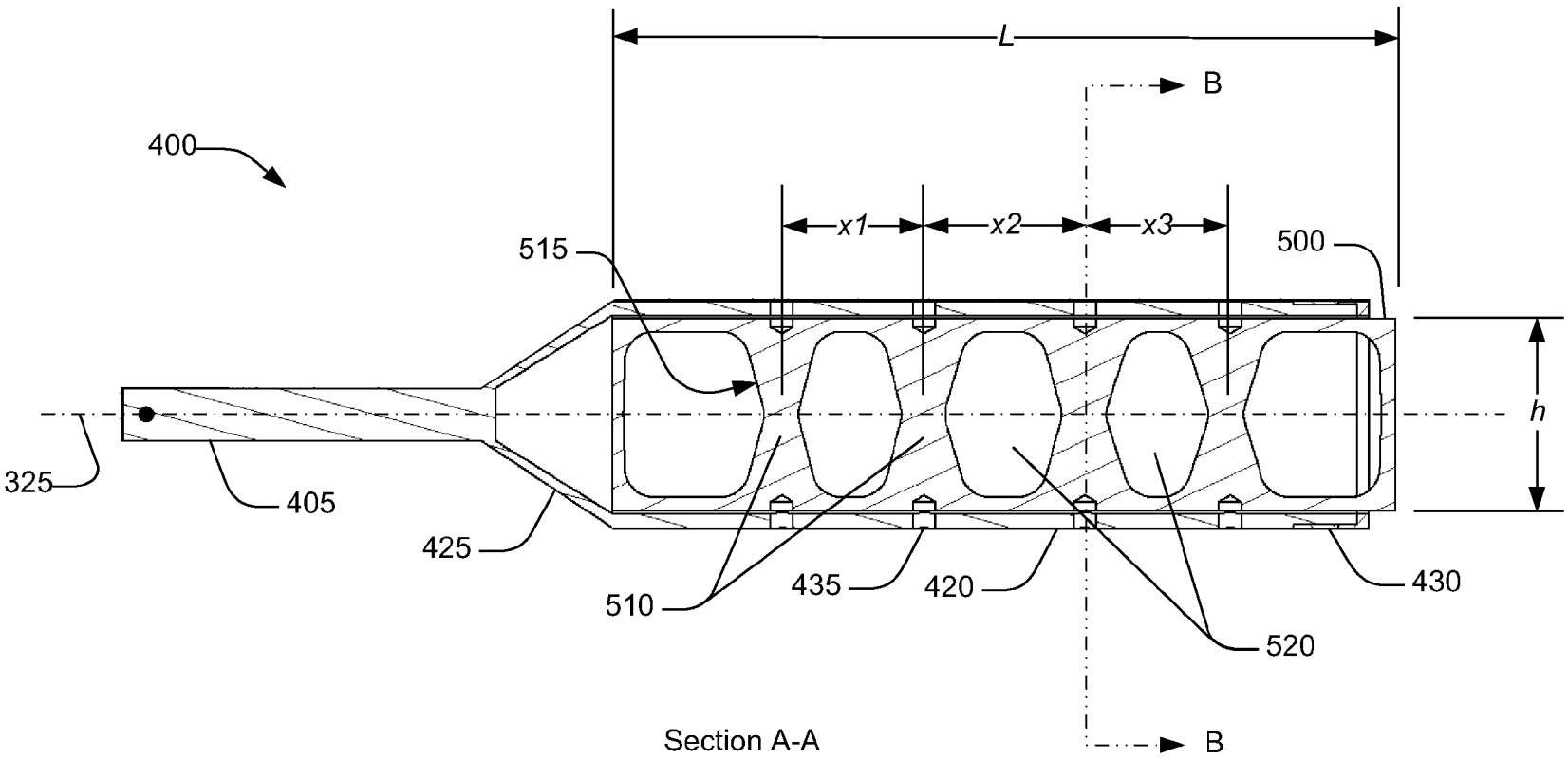
FIG. 2 is a longitudinal cross-sectional view of an exemplary rotatable filter-polarizer element.

Referring now to FIG. 2, a rotatable filter-polarizer element 400 may include the cylindrical stem 405 and the hollow conical section 425 that were partially visible in FIG. 1. The hollow conical section 425 may couple the cylindrical stem 405 to a hollow dielectric tube 420. The cylindrical stem 405, the dielectric tube 420, and the conical section 425 may be coaxial about a common axis 325. A phase shifting element 500 may be disposed within and coupled to the dielectric tube 420. The phase shifting element 500 may be a rectangular dielectric slab or card having a length L and a height h. The length of the phase shifting element 500 may extend through a length of the dielectric tube 420. Placing the phase shifting element 500 within the dielectric tube 420 may ensure that the phase shifting element 500 is symmetrical with respect to the axis 325 along the entire length of the phase shifting element. Retaining symmetry is important since any asymmetry may cause coupling of electromagnetic energy from desired HE11 propagation modes into undesired high-order propagation modes.

The rotatable filter-polarizer element 400 may be fabricated from one or more dielectric materials that have low loss at the frequency of operation of the rotatable filter polarizer element. The rotatable filter-polarizer element 400 may be fabricated from a low-loss polystyrene plastic material such as REXOLITE® (available from C-LEC Plastics) or another plastic material. The cylindrical stem 405, the dielectric tube 420, and the conical section 425 may be machined from a single piece of dielectric material, or may comprise multiple pieces of dielectric material attached together with adhesive bonding or other technique. The rotatable phase shifting element 400 may also be fabricated by casting or injection molding or by a combination of molding and machining operations.

One or more tube bushings 430 may be provided along the exterior of the dielectric tube 420. The tube bushing 430 may be configured to fit snuggly within the inside of a cylindrical waveguide such as the cylindrical waveguide 300 of FIG. 1, such that the dielectric tube 420 remains centered within the cylindrical waveguide as the rotatable filter-polarizer element 400 is rotated. The tube bushing 430 may be made of, or coated with, TEFLON® or other fluorinated polymer, graphite, ceramic, or other material having a smooth and/or slippery surface such that the tube bushing 430 may rotate smoothly within the cylindrical waveguide.

Figure 3:
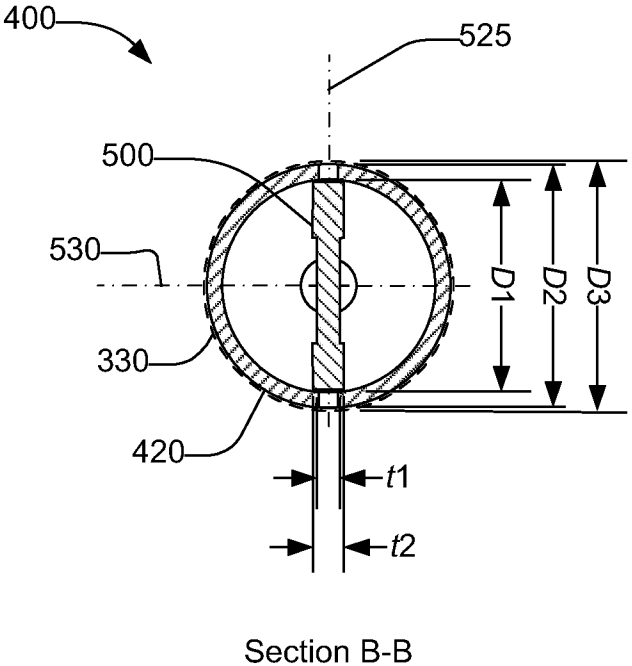
FIG. 3 is a transverse cross-sectional view of the exemplary rotatable filter-polarizer element.

FIG. 3 is a cross-sectional view of the rotatable filter-polarizer element 400 at a plane B-B defined in FIG. 2. The rotatable filter-polarizer element 400 is configured to fit within a cylindrical waveguide having an inside diameter D3, which is shown as a dashed line 330. The phase shifting element 500 may be disposed within the dielectric tube 420. The dielectric tube 420 may have an inside diameter D1 and an outside diameter D2. The phase shifting element 500 may have a width extending across the inside diameter D1 of the dielectric tube 420. The phase shifting element may have a thickness substantially smaller than its width. The thickness of the phase shifting element may be stepped. For example, a thickness t2 of outer portions of the phase shifting element 500 may be greater than a thickness t1 of a central portion of the phase shifting element.

The phase shifting element 500 may be parallel to and symmetrical about a first axis 525. The phase shifting element 500 may also be symmetrical about a second axis 530 orthogonal to the first axis 525. When the rotatable filter-polarizer 400 is disposed within a waveguide, the presence of the phase shifting element 500 may cause a relative phase shift between signals polarized parallel to the first axis 525 with respect to signals polarized parallel to the second axis 530. Since signals polarized parallel to the first axis 525 will be delayed in phase with respect to signals polarized parallel to the second axis 530, the first axis 525 may be referred to as the "slow" axis and the second axis 530 may be referred to as the "fast" axis.

The phase shifting element 500 may be designed to introduce a nominal phase shift, between signals polarized along the fast and slow axes, of 180 degrees, 90 degrees, or some other value. The phase shifting element 500 may be designed to provide an essentially constant phase shift over a predetermined frequency band. In this patent, the word "essentially" means "to within an acceptable tolerance". The value of an acceptable tolerance may depend on the specific requirements of an application.

A phase shifting element providing a phase shift of essentially 90 degrees may be used to convert a linearly polarized mode into or from a circularly polarized mode. A rotatable phase shifting element providing a phase shift of essentially 90 degrees may be used as a switch to selectably convert a linearly polarized mode to one of an unchanged linearly polarized mode, a left-hand or right-hand circularly polarized mode, or a left-hand or right-hand elliptically polarized mode.

A phase shifting element providing a phase shift of essentially 180 degrees may be used to rotate the polarization angle of linearly polarized modes within a waveguide.

Referring back to FIG. 2, the phase shifting element 500 may be perforated by a plurality of openings 520 that define a plurality of phase shifting regions 510. The shapes of the phase shifting regions 510 and the openings 520 may have mirror symmetry about a plane normal to the plane of the drawing in FIG. 2 that includes the axis 325. Both sides 515 of each phase shifting region 510 may taper inward, forming a waist at the axis 325, to provide a gradual impedance change between the phase shifting regions 510 and the adjacent openings 520.

The phase shifting regions 510 may be configured to provide, in combination, a desired phase shift, such as 90 degrees or 180 degrees, between two orthogonal electromagnetic waves propagating in the cylindrical waveguide 300. The phase shifting regions 510 and the openings 520 may also be configured to act as a filter to suppress one or more undesired modes from propagating in the cylindrical waveguide 300. The phase shifting regions 510 and the openings 520 may be configured to allow propagation of orthogonal HE11 modes over a predetermined operating bandwidth while suppressing, or cutting off, at least an HM01 mode over the same operating bandwidth. For example, the phase shifting element 500 may be configured such that the HM01 mode can propagate in the phase shifting regions 510 but is cut off in the openings 520.

The center-to-center spacings (x1, x2, x3) of the phase shifting regions 510 may be, on average, about one-quarter wavelength at the center of the operating bandwidth, where the wavelength is defined for the portions of the cylindrical waveguide 300 between the phase shifting regions (the portions where the phase shifting element 500 has the openings 520). The center-to-center spacing of the phase shifting regions 510 may vary due to optimization performed by a microwave device design software tool such as CST Microwave Studio. For example, an initial model of the feed network 100 may be generated with the center-to-center spacing of the phase shifting regions 510 equal to one-quarter wavelength. The structure may then be analyzed by the software design tool and the dimensions of the model may be iterated and optimized automatically to achieve desired performance parameters such as reflection coefficients at the three ports of the feed network 100 and isolation between the branch ports of the OMT 200. After this optimization process, the center-to-center spacing of the phase shifting regions 510 may vary, for example, by up to about 10% from one-quarter wavelength.

To ensure that the undesired HM01 mode does not resonate within the feed network 100, the Transverse Resonance Method may be employed. To employ this method, a model of the feed network 100 is split at a plane orthogonal to the optical axis and passing through the center of one of the phasing shifting regions 510. For example, the model may be split at the plane C-C identified in FIG. 4. The HM01 mode may be excited at this split. The reflection phase for the HM01 mode propagating to the left of the split may be calculated. Similarly, the reflection phase for the HM01 mode propagating to the right of the split may be calculated. If the sum of the reflection phase for the HM01 mode propagating to the left and the reflection phase for the HM01 mode propagating to the right of the split are about zero or 360 degrees, the HM01 mode may resonate within the feed network. If the sum of the reflection phases for the HM01 modes propagating to the left and to the right of the split do not add up to zero or 360 degrees (+/− about 10 degrees), for all wavelengths within the operating wavelength band, the HM01 mode will not resonant within the feed network 100.

The phase shifting element 500 may be retained within the hollow cylindrical tube 420 by a plurality of fasteners 435. The fasteners 435 may be inserted through the wall of the dielectric tube 420 into the edges of the phase shifting element 500. The fasteners may be, for example, dielectric pins pressed into mating holes in the dielectric tube 420 and the phase shifting element 500. Other fasteners, such as dielectric screws, may also be used. The fasteners 435 may be conveniently located at the centers of the phase shifting regions 510.

For example, a rotatable filter-polarizer element 400 to provide a 90-degree phase shift in an X-band feed network (7.25 GHz-7.75 GHz receive band and 7.9 GHz-8.4 GHz transmit band) may have the following dimensions identified in FIG. 2 and FIG. 3: L=3.327; x1=0.608; x2=0.688; x3=0.621; D1=0.850; D2=0.970; D3=0.980 (inside diameter of cylindrical waveguide); t1=0.166; and t2=0.184. Rotatable filter-polarizer elements for other wavelength bands will have different dimensions.

Figure 4:
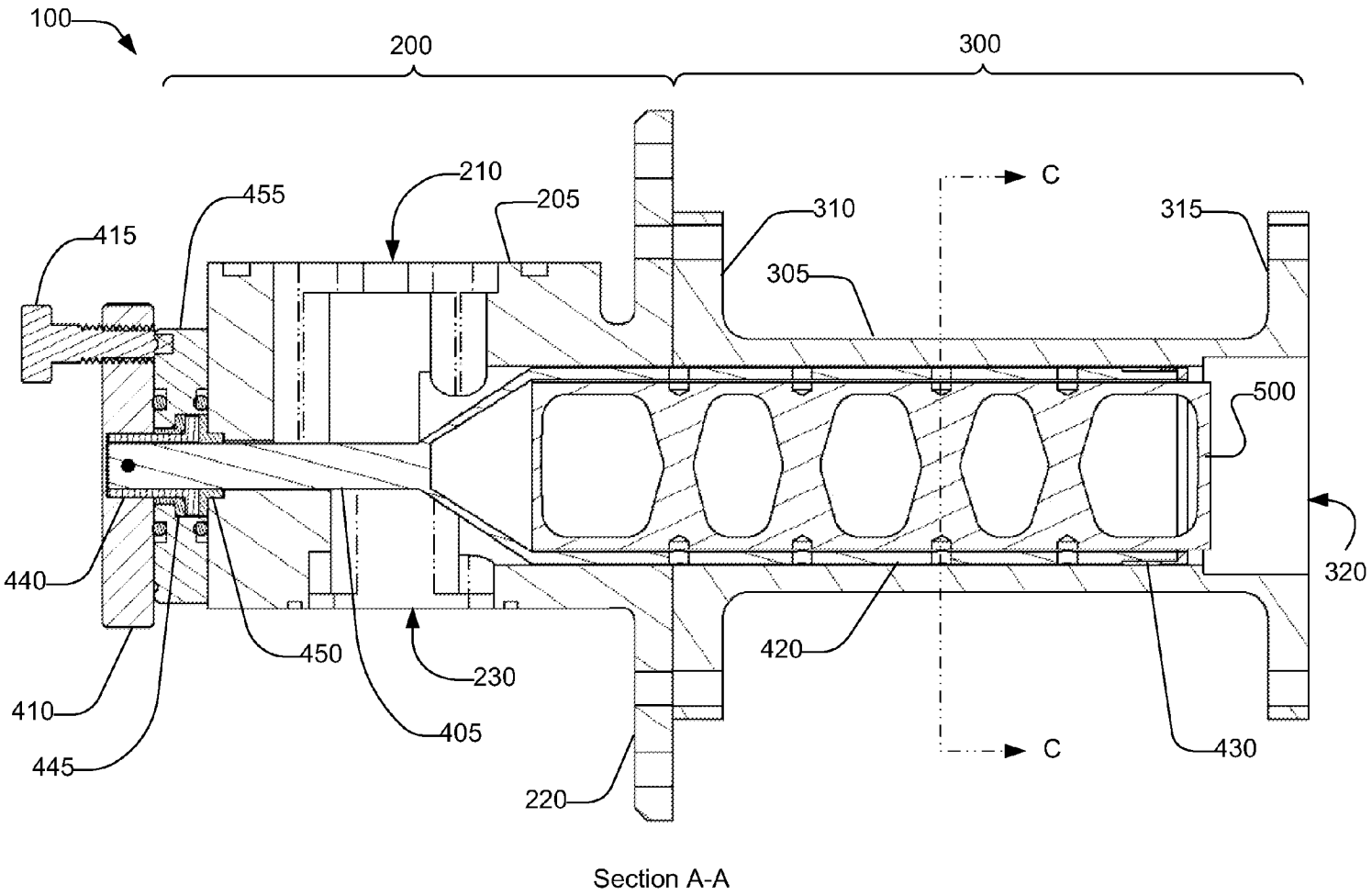
FIG. 4 is a longitudinal cross-sectional view of the exemplary feed network including the rotatable filter-polarizer element.

FIG. 4 shows a longitudinal cross-sectional view of the feed network 100 along the plane A-A (defined in FIG. 1) including the OMT 200 and the cylindrical waveguide 300. Portions of the OMT 200 identified in FIG. 4 include the OMT body 205, the first branch port 210, and the common port flange 220. Also visible in FIG. 4 is a second branch port port 230 for coupling a second $HE_{11}$ mode, orthogonal to the first $HE_{11}$ mode, into or from the cylindrical waveguide 300. As shown in FIG. 4, the second branch port 230 may be opposed to, or on the opposite side of the OMT body 205 from, the first branch port 210. Other OMT configurations, in which the first and second branch ports are not opposed, may be used.

Portions of the cylindrical waveguide 300 identified in FIG. 4 include the cylindrical tube 305, the first flange 310, the second flange 315, and the common port 320.

The OMT body 205 and the cylindrical waveguide 300 may be fabricated from a conductive material. The OMT body 205 and the cylindrical waveguide 300 may be typically fabricated from an aluminum alloy, but other metal materials such as copper and brass may be used. The OMT body 205 and the cylindrical waveguide 300 may be fabricated from a non-conductive material, such as a molded plastic material, having a suitable conductive coating such as a metal film.

Portions of the rotatable filter-polarizer element 400 identified in FIG. 4 include the stem 405, the adjustment knob 410, the locking screw 415, the dielectric tube 420, and the tube bushing 430. The tube bushing 430 may fit snuggly within the inside of the cylindrical tube 305 such that the rotatable filter-polarizer element 400 remains centered within the cylindrical tube 305 as the rotatable filter-polarizer element 400 is rotated. In FIG. 4, the rotatable filter-polarizer element 400 is shown rotated such that the phase shifting element 500 is aligned with the section plane A-A.

The adjustment stem 405 may be coupled to a flanged shaft 440 using a pin, key or other mechanism (not visible). The flanged shaft 440 may in turn be coupled to the adjustment knob 410. The adjustment stem 405 and the shaft 440 may be rotatable within a second bearing. In the example of FIG. 4, the second bearing may consist of an inner bushing 450 and an outer bushing 445 which are retained against the OMT body 205 by a cap 455. The bushings 445 and 450 may also be made of TEFLON® or other material having a smooth and/or slippery surface.

The use of bushings 445 and 450, and the tube bushing 430 in the feed network 100 of FIG. 4 is exemplary. When justified by the mechanical requirements of the feed network 100, either or both of the shaft 440 and the dielectric tube 420 may rotate within a roller bearing, ball bearing, or other type of bearing.

Figure 5:
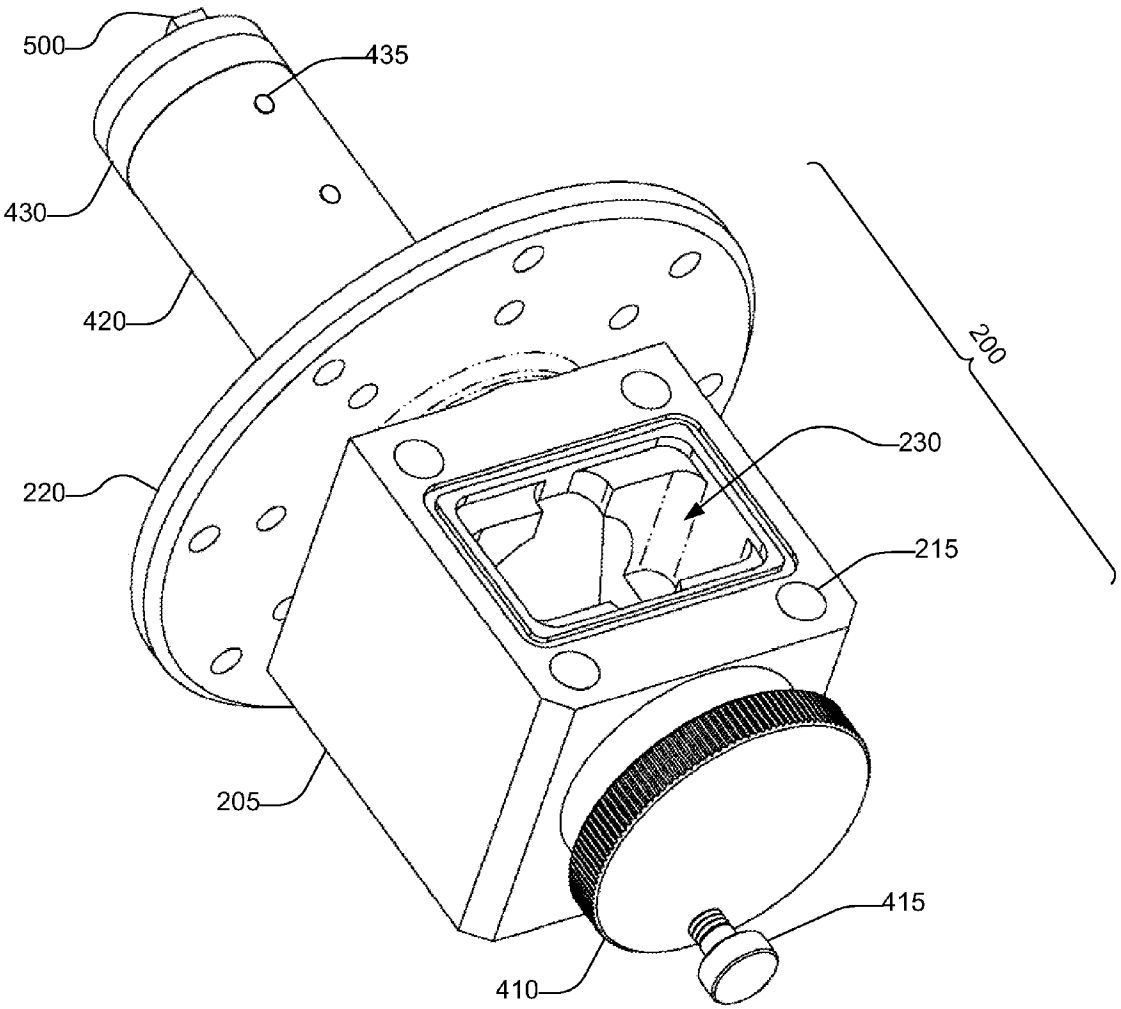
FIG. 5 is a perspective view of the exemplary feed network.

FIG. 5 shows a perspective view of portions of a feed network, such as the feed network 100 of FIG. 1. Specifically, FIG. 5 shows the OMT 200 and rotatable filter-polarizer 420 without the cylindrical waveguide (300 in FIG. 1) that would normally enclose the rotatable filter polarizer 420. Previously described elements visible in FIG. 5 include the OMT body 205, mounting holes 215, the common port flange 220, the second branch port 230, the adjustment knob 410, the lock screw 415, the rotatable dielectric tube 420, the tube bushing 430, mounting pins 435, and the phase shifting element 500.

Figure 6:
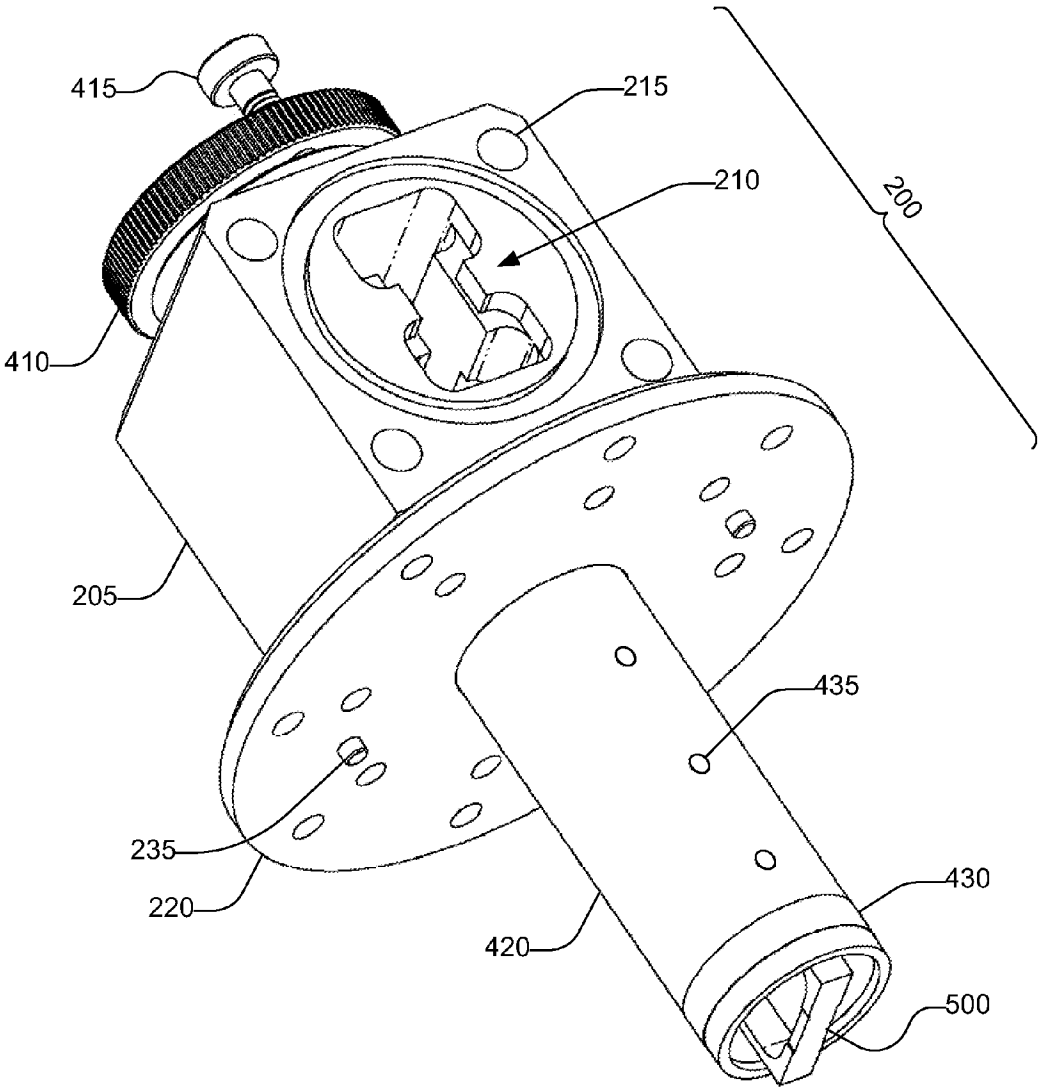
FIG. 6 is a perspective view of the exemplary feed network.

FIG. 6 shows another perspective view of the OMT 200 and rotatable filter-polarizer 420 without the cylindrical waveguide (300 in FIG. 1) that would normally enclose the rotatable filter polarizer 420. Previously described elements visible in FIG. 6 include the OMT body 205, the first branch port 210, mounting holes 215, the common port flange 220, the adjustment knob 410, the lock screw 415, the rotatable dielectric tube 420, the tube bushing 430, mounting pins 435, and the phase shifting element 500. One or more pins 235 may extend from the common port flange 220 to align the OMT 200 in a specific orientation when the OMT is coupled to a cylindrical waveguide (not shown).

Figure 7:
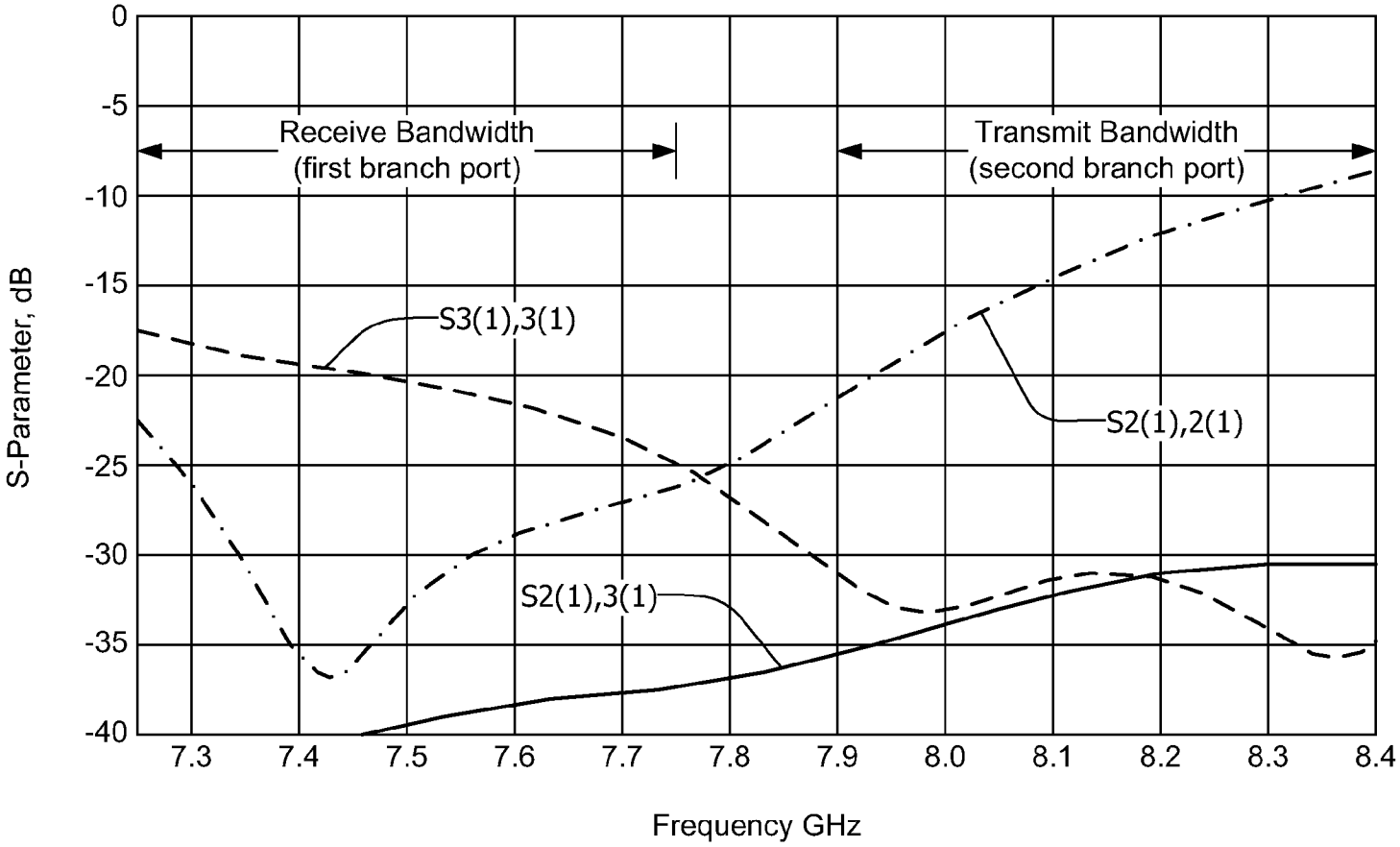
FIG. 7 is a graph showing the simulated performance of an exemplary feed network including a rotatable phase shifting element.

FIG. 7 shows a graph illustrating the simulated performance of an exemplary feed network including a rotatable filter-polarizer. The simulated exemplary feed network is similar to the feed network 100, as shown in FIG. 1 and FIGS. 4-6, and the rotatable filter-polarizer is similar to the rotatable filter-polarizer 400, as shown in FIG. 2. The exemplary feed network was designed for a specific application in an X-band satellite communications terminal using circularly polarized uplink and downlink signals. The bandwidth for the received signal is from 7.25 GHz to 7.75 GHz and the bandwidth of the transmitted signal is 7.9 GHz to 8.4 GHz. The performance of the exemplary feed network was simulated using finite integral time domain analysis. The time-domain simulation results were Fourier transformed into frequency-domain data as shown in FIG. 7.

The dash-dot line S2(1),2(1) is a graph of the return loss at the receive port (first branch port) of the feed network, and the dashed line S3(1),3(1) is a graph of the return loss at the transmit port (second branch port) of the feed network. The return loss S2(1),2(1) at the receive port is less than −22 dB over the operating bandwidth of the receive port and the return loss S3(1),3(1) at the transmit port is less than −30 dB over the operating bandwidth of the transmit port.

The solid line S2(1),3(1) is a graph of the cross-coupling between the receive port and the transmit port. The cross coupling is less than −30 dB over the transmit operating bandwidth and less than −35 dB over the receive operating bandwidth.

Figure 8:
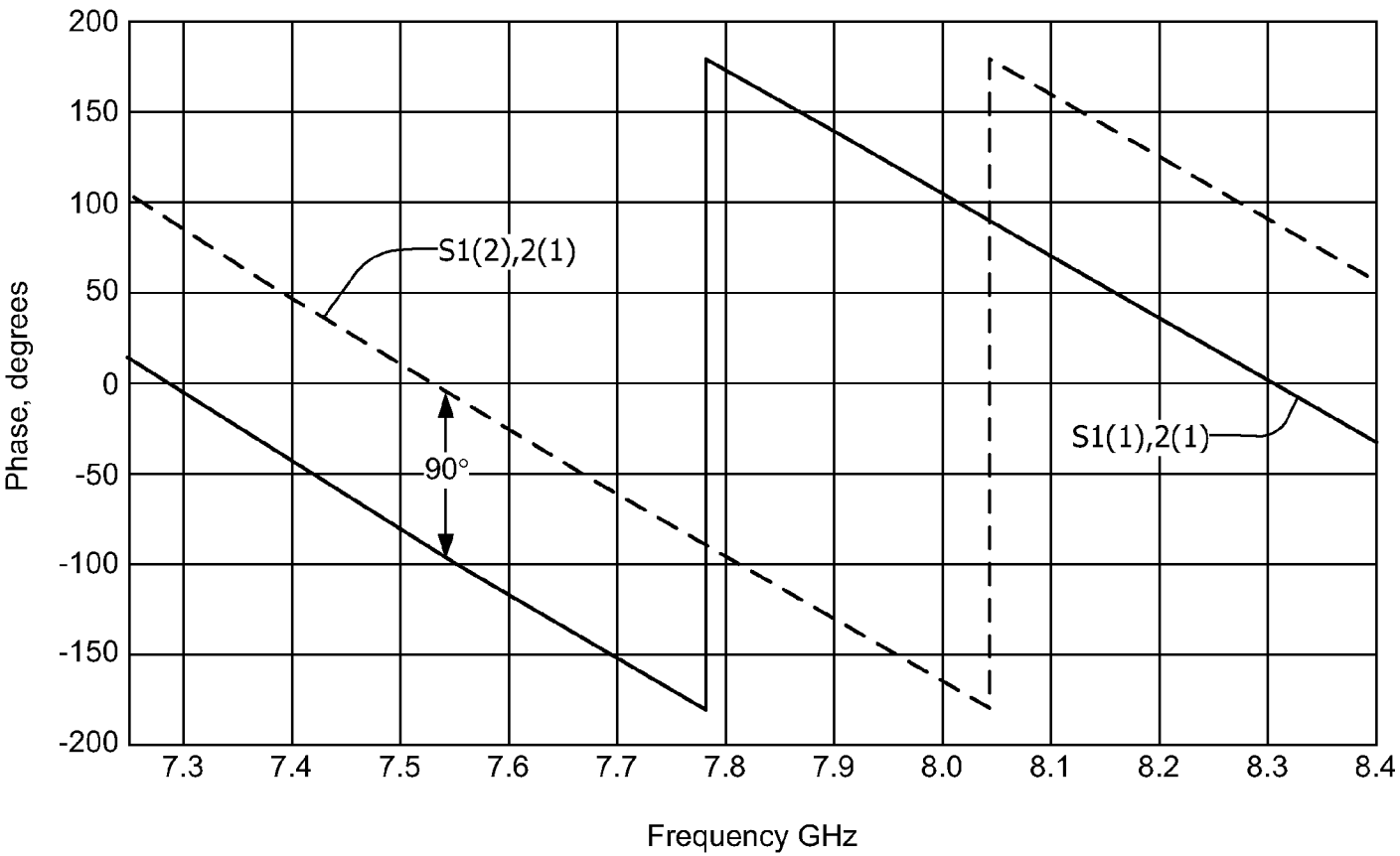
FIG. 8 is a graph showing the simulated performance of an exemplary feed network including a rotatable phase shifting element.
Figure 9:
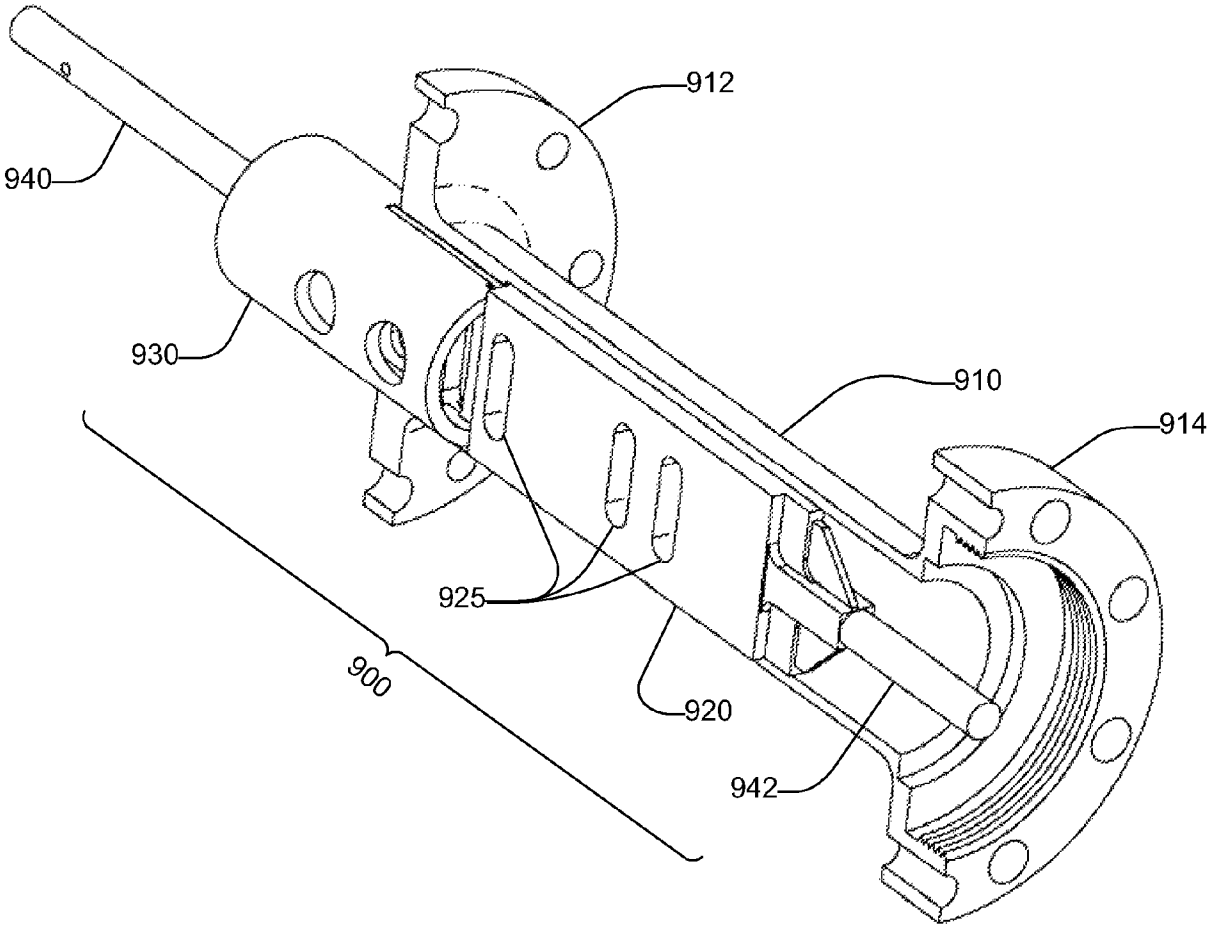
FIG. 9 PRIOR ART
FIG. 9 is a perspective, partially cross-sectional, view of a prior art rotatable polarizer element.

FIG. 8 is another graph illustrating the simulated performance of the exemplary feed network. The dashed line S1(2),2(1) and the solid line S1(1),2(1) plot the phase shift introduced by the simulated rotatable filter-polarizer element to two orthogonal linearly polarized $HE_{11}$ modes. The difference in the phase shifts imparted to the two orthogonal linearly polarized $HE_{11}$ modes is essentially 90 degrees over a frequency band from 7.25 GHz to 8.4 GHz.

Closing Comments

Throughout this description, the embodiments and examples shown should be considered as exemplars, rather than limitations on the apparatus and procedures disclosed or claimed. Although many of the examples presented herein involve specific combinations of apparatus elements, it should be understood that those acts and those elements may be combined in other ways to accomplish the same objectives. Elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A feed network comprising:

a cylindrical common waveguide having an axis and terminating in a common port;

an orthomode transducer having a first port for coupling a first linearly polarized mode to the cylindrical common waveguide and a second port for coupling a second linearly polarized mode to the cylindrical common waveguide, the second linearly polarized mode orthogonal to the first linearly polarized mode; and a filter-polarizer element disposed within and rotatable about the axis of the cylindrical common waveguide, the filter-polarizer element further comprising:

an elongated hollow dielectric tube coaxial with the cylindrical common waveguide; and a phase shifting element disposed within the dielectric tube, the phase shifting element comprising a rectangular dielectric card, the rectangular dielectric card having a length extending along a length of the dielectric tube, a width extending across an inside diameter of the dielectric tube, and a thickness substantially smaller than the width, wherein:

the phase shifting element is perforated by a plurality of openings defining alternating phase shifting regions and open regions, the phase shifting regions are configured to cause, in combination, a predetermined relative phase shift between a first signal and a second signal propagating in the cylindrical common waveguide, and the open regions are configured to suppress propagation of at least one undesired mode in the cylindrical common waveguide.

2. The feed network of claim 1, wherein:

a polarization direction of the first signal is parallel to the width of the rectangular dielectric card, and a polarization direction of the second signal is parallel to the thickness of the rectangular dielectric card.

3. The feed network of claim 1, wherein:

a center-to-center spacing of adjacent phase shifting regions is about one-quarter of an operating wavelength of the feed network.

4. The feed network of claim 1, the rotatable filter-polarizer element further comprising:

an adjustment stem coupled to the hollow dielectric tube by a hollow conical section, the adjustment stem and the conical section coaxial with the dielectric tube, wherein the phase shifting element may be rotated about the axis of the cylindrical common waveguide by rotating the adjustment stem.

5. The feed network of claim 4, further comprising:

a shaft coaxial with and coupled to the adjustment stem, wherein the phase shifting element may be rotated about the axis of the cylindrical common waveguide by rotating the shaft.

6. The feed network of claim 5, wherein:

an end of the dielectric tube remote from the adjustment stem includes a first bushing that is rotatable in contact with an inner surface of the cylindrical common waveguide, and the adjustment stem and/or the shaft are rotatable within a bearing.

7. The feed network of claim 1, wherein the predetermined relative phase shift is essentially 180 degrees.

8. The feed network of claim 1, wherein the predetermined relative phase shift is essentially 90 degrees.

9. A filter-polarizer element for use in a cylindrical waveguide, comprising:

an elongated hollow dielectric tube configured to be rotatable within the cylindrical waveguide; and a phase shifting element disposed within the dielectric tube, the phase shifting element comprising a rectangular dielectric card, the rectangular dielectric card having a length extending along a length of the dielectric tube, a width extending across an inside diameter of the dielectric tube, and a thickness substantially smaller than the width, wherein:

the phase shifting element is perforated by a plurality of openings defining alternating phase shifting regions and open regions, the phase shifting regions are configured to cause, in combination, a predetermined relative phase shift between a first signal and a second signal propagating in the cylindrical waveguide, and the open regions are configured to suppress propagation of at least one undesired propagation mode in the cylindrical waveguide.

10. The filter-polarizer element of claim 9, wherein:

a polarization direction of the first signal is parallel to the width of the rectangular dielectric card, and a polarization direction of the second signal is parallel to the thickness of the rectangular dielectric card.

11. The filter-polarizer element of claim 9, wherein:

a center-to-center spacing of adjacent phase shifting regions is about one-quarter of an operating wavelength of the feed network.

12. The filter-polarizer element of claim 9, wherein the predetermined relative phase shift is essentially 180 degrees.

13. The filter-polarizer element of claim 9, wherein the predetermined relative phase shift is essentially 90 degrees.

14. The filter-polarizer element of claim 9, the rotatable filter-polarizer element further comprising:

an adjustment stem coupled to the dielectric tube by a hollow conical section, the adjustment stem and the conical section coaxial with the dielectric tube.

15. The filter-polarizer element of claim 14, further comprising:

a bushing disposed on an outer surface of the dielectric tube, the bushing configured to rotate in contact with an inner surface of the cylindrical waveguide.

* * * * *